US005950945A

United States Patent [19]

Schaller

[11] Patent Number: 5,950,945

[45] Date of Patent: Sep. 14, 1999

[54] IMPACT MEMBER FOR COMMINUTER

[75] Inventor: Steven M. Schaller, Bonner County, Id.

[73] Assignee: The Monee Group, Ltd., Missoula, Mont.

[21] Appl. No.: 09/130,577

[22] Filed: Aug. 6, 1998

[51] Int. Cl.[6] ..... B02C 13/02; B02C 13/28

[52] U.S. Cl. ..... 241/189.1; 241/191; 241/197; 241/300

[58] Field of Search ..... 241/189.1, 191, 241/197, 300, 293, 294

[56] References Cited

U.S. PATENT DOCUMENTS

| | | | |
|---|---|---|---|
| 2,467,865 | 4/1949 | Smith | 241/197 |
| 3,642,214 | 2/1972 | Blackwell, Jr. | 241/191 |
| 3,840,187 | 10/1974 | Brewer | 241/32 |
| 4,151,959 | 5/1979 | Deister | 241/69 |
| 4,162,770 | 7/1979 | Lewis . | |
| 4,171,778 | 10/1979 | Lejeune . | |
| 4,658,875 | 4/1987 | Grabovac . | |
| 4,675,975 | 6/1987 | Kucharczyk . | |
| 4,848,681 | 7/1989 | Eriksson . | |
| 4,871,119 | 10/1989 | Murata . | |
| 5,044,570 | 9/1991 | Montgomery, Sr. | 241/294 |
| 5,060,875 | 10/1991 | McBride . | |
| 5,165,611 | 11/1992 | Ragnarsson | 241/88.4 |
| 5,183,089 | 2/1993 | Norlander . | |
| 5,273,218 | 12/1993 | Burns | 241/32 |
| 5,368,243 | 11/1994 | Gold . | |
| 5,392,997 | 2/1995 | Comensoli . | |
| 5,544,826 | 8/1996 | Klingler . | |

*Primary Examiner*—John M. Husar
*Attorney, Agent, or Firm*—R. Jonathan Peters

[57] ABSTRACT

The invention provides an impact member for assembly with a rotor arranged in a comminuter used for the size reduction of feed material. The impact member, disposed radially about the rotor, comprises a carrier and a replaceable impact plate both configured for complementary registration so as to be cantilevered from the carrier and to provide an essentially locking arrangement to withstand the impact forces without coming loose. The carrier has a forwardly disposed open recess or channel with first and second facings intersecting in an axial direction relative to the horizontal axis of the rotor, and defining an acute angle relative to the radial plane of the rotor. The first facing is oriented in the general direction of rotation of the rotor and terminates with a longitudinally extending marginal edge disposed axially relative to the horizontal axis of the rotor. The replaceable impact plate is configured as a substantially non-right angled parallelogram as viewed in transverse profile, and has intersecting sides for complementary registration with the first and second facings of the recess. Thus, when the replaceable impact plate is arranged in the recess with side walls matching the facings of the recess, the impact plate is cantilevered from the recess so as to project outwardly from the marginal edge. The impact plate includes a leading edge oriented in the general direction of rotation of the rotor. This complementary registration of the two members essentially locks the replaceable impact plate in the recess so as to withstand the resulting impact forces occurring during operation of the machine. A suitable fastening element, such as a relatively low torque bolt, holds the wear resistant member in place on the carrier.

9 Claims, 7 Drawing Sheets

IMPACT MEMBER FOR COMMINUTER

FIELD OF THE INVENTION

This invention relates to an impact member for a comminuter. In its more specific aspect, this invention relates to an impact member for assembly with a rotor mounted in a housing for comminuting or reducing input feed.

BACKGROUND OF THE INVENTION AND PRIOR ART

There is known in the art comminuting machines or apparatus utilizing an impact hammer for comminuting, crushing, pulverizing, shearing, or cutting various materials such as wood products, waste wood, ores, concrete, aggregate, soft metal, scrap, and the like. For this purpose, there are two types of comminuters; namely, the fixed or stationary comminuter, and the swinging hammer comminuter, and machines of both types have been in use for many years and are used extensively in commercial operations.

In general, a fixed comminuter comprises a housing with a reducing chamber having an inlet for feeding material to the reducing chamber and an outlet for discharging material of reduced size. An impact rotor is arranged in the reducing chamber, and is mounted on a horizontal drive shaft driven by a suitable motor. A plurality of hammers or strikers are mounted along the periphery of the rotor or radially of the rotor, and each hammer has a striking or impact surface oriented in the general direction of rotation of the rotor. The feed is directed against the striking or impact surface of the hammer and repelled with force against an anvil spaced from the hammers. The impact of the material against the hammers and anvil, and any ricocheting of the material in the chamber, reduces the size of the feed. That is, during each revolution of the rotor, the feed pieces are sheared, cut, ground, etc., during each revolution of the rotor.

A swinging hammer comminuter generally includes a hammer pivotally connected to a rotor, and the hammer is free to swing as the rotor revolves. The hammer has an impact or striking surface oriented in the direction of rotation of the rotor, and feed material is directed against the impact surface, thereby resulting in size reduction of the feed as explained above with reference to the stationary comminuter.

Although machines or apparatus of this type have been in common use for many years, a distinct disadvantage with the machine is that the hammer or striker is subject to wear and deterioration. The leading edge, sometimes referred to as the cutting edge or outboard edge, of the hammer performs most of the cutting action of the feed material, and therefore encounters most of the impact forces. As a consequence, the hammer must be replaced with frequency depending on such factors as the type of feed and the inertia of the rotor. Also, the hammer is fastened to the rotor with relatively large bolts capable of exhibiting a torque of about 1,600 foot pounds per inch or higher. As a result of the high impact forces created by the inertia of the rotor, the bolts become fatigued or distorted, and as a consequence fail, which can occur before the cutting edge of the impact hammer deteriorates. Hence, downtime of a machine is relatively frequent because of failure of the fastening bolts, or deterioration of the hammer, or both. In a typical comminuter for cutting wood product, sometimes referred to in the art as a wood hog, nine to twenty four hammers are arranged on a rotor. When a replacement of worn parts is required, to change, for example, nine hammers takes about nine man hours, which translates into downtime or idling of a machine and additional man hours lost by idling loaders and unloaders.

This invention has therefore as it purpose to provide an improved impact member requiring substantially less downtime to change as compared to the conventional hammer, and is very cost effective.

SUMMARY OF THE INVENTION

In accordance with the present invention, there is provided an impact member for assembly with a rotor arranged in a comminuter used for the size reduction of feed material as by cutting, shearing, pulverizing, and the like. The impact member comprises a carrier and a replaceable impact plate both configured for complementary registration so as to be cantilevered from the carrier and to provide an essentially locking arrangement to withstand the impact forces without coming loose. The carrier is adaptable for extending substantially radially of the rotor and has a forwardly disposed open recess or channel with first and second facings intersecting in an axial direction relative to the horizontal axis of the rotor. The intersecting faces define an acute angle relative to the radial plane of the rotor, that is, when viewed in transverse profile. The first facing, preferably being substantially planar or flat, is oriented in the general direction of rotation of the rotor and terminates with a longitudinally extending marginal edge disposed axially relative to the horizontal axis of the rotor. The replaceable impact plate is configured as a substantially non-right angled parallelogram as viewed in transverse profile, and has intersecting sides for complementary registration or matching registration with the first and second facings of the recess. Thus, when the replaceable impact plate is arranged in the recess or channel with side walls matching the facings of the recess, the wear resistant member is cantilevered from the recess so as to project outwardly from the marginal edge. The impact plate includes a leading edge oriented in the general direction of rotation of the rotor. It thus will be observed that this complementary registration of the two members essentially locks the replaceable impact plate in the recess so as to withstand the resulting impact forces occurring during operation of the machine. A suitable fastening element, such as a relatively low torque bolt, holds or prevents undesired disengagement of the impact plate so as to hold it in place on the carrier.

The recess or channel of the carrier when viewed in transverse profile relative to the radial plane of the rotor defines an acute angle, as explained above. The first facing of the recess oriented in the general direction of the rotation of the rotor can be sloped forwardly relative to the radial plane of the rotor, or the slope can be substantially parallel to the radial plane, or the slope can be negative relative to the radial plane. It is preferable that the recess extend the full longitudinal length of the carrier, and that a plurality of replaceable impact plates are arranged axially and in abutting relationship in the recess. In an alternative embodiment, the carrier and impact plate for assembly with the rotor can be arranged in increasing radial angles in the axial direction of the rotor so as to create cutting edges having stepped surfaces. Also, where desired, one or both of the matching surfaces of the recess and the wear resistant member can be serrated. An additional advantage of my invention is that the leading edge or outboard edge of the impact plate assumes most of the impact and therefore when sufficiently worn to loose its effective action, this member can be turned or flip-flopped to expose an used edge.

BRIEF DESCRIPTION OF THE DRAWINGS

FIGS. 7A, 73, and 7C show three different slopes for one of the facings of the recess for the carrier.

DETAILED DESCRIPTION OF THE INVENTION

Figure 1:
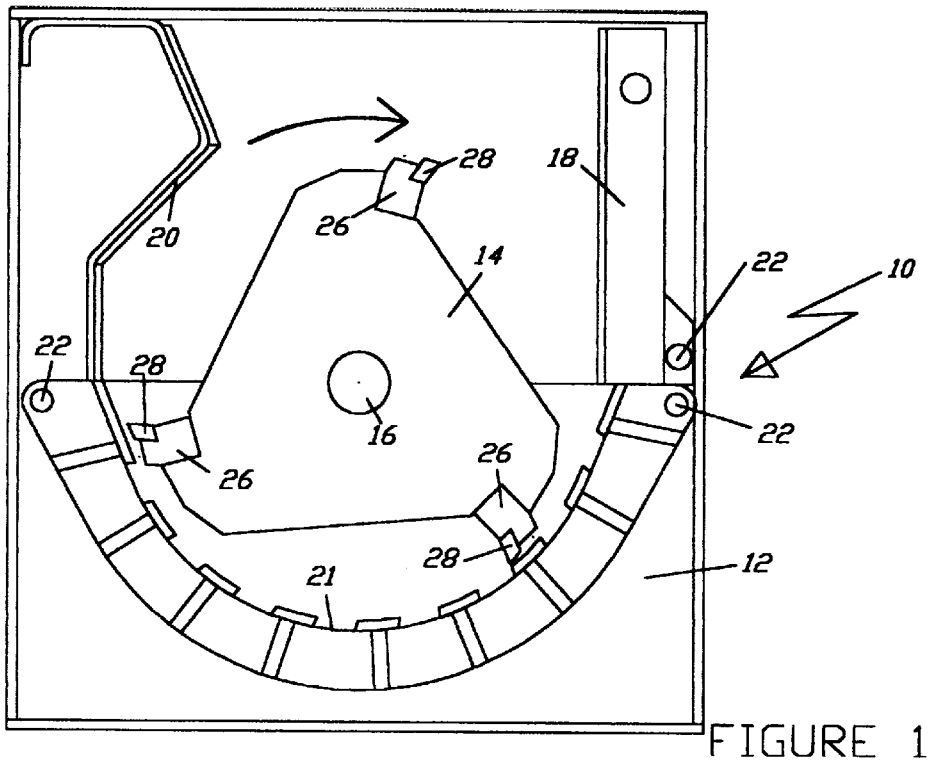
FIG. 1 is a side elevational view of the interior of a typical stationary comminuter embodying the impact member of the present invention.
Figure 2:
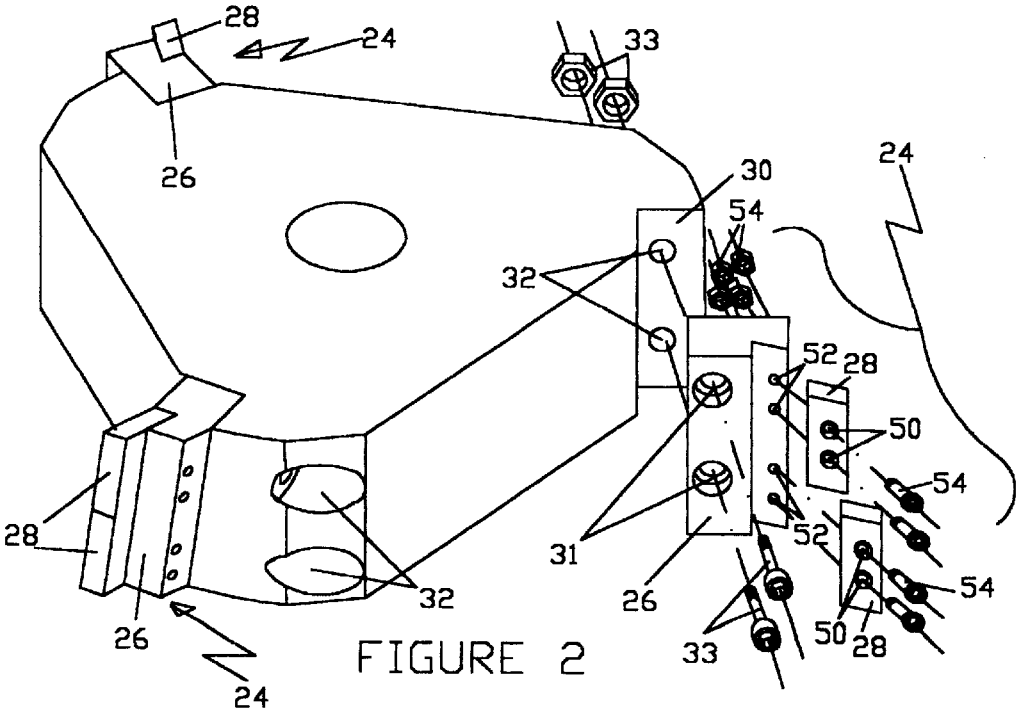
FIG. 2 is a perspective view of an impact rotor for a stationary comminuter showing the impact member of the present invention assembled on the rotor and includes an exploded view of the impact member for assembly with the rotor.
Figure 3:
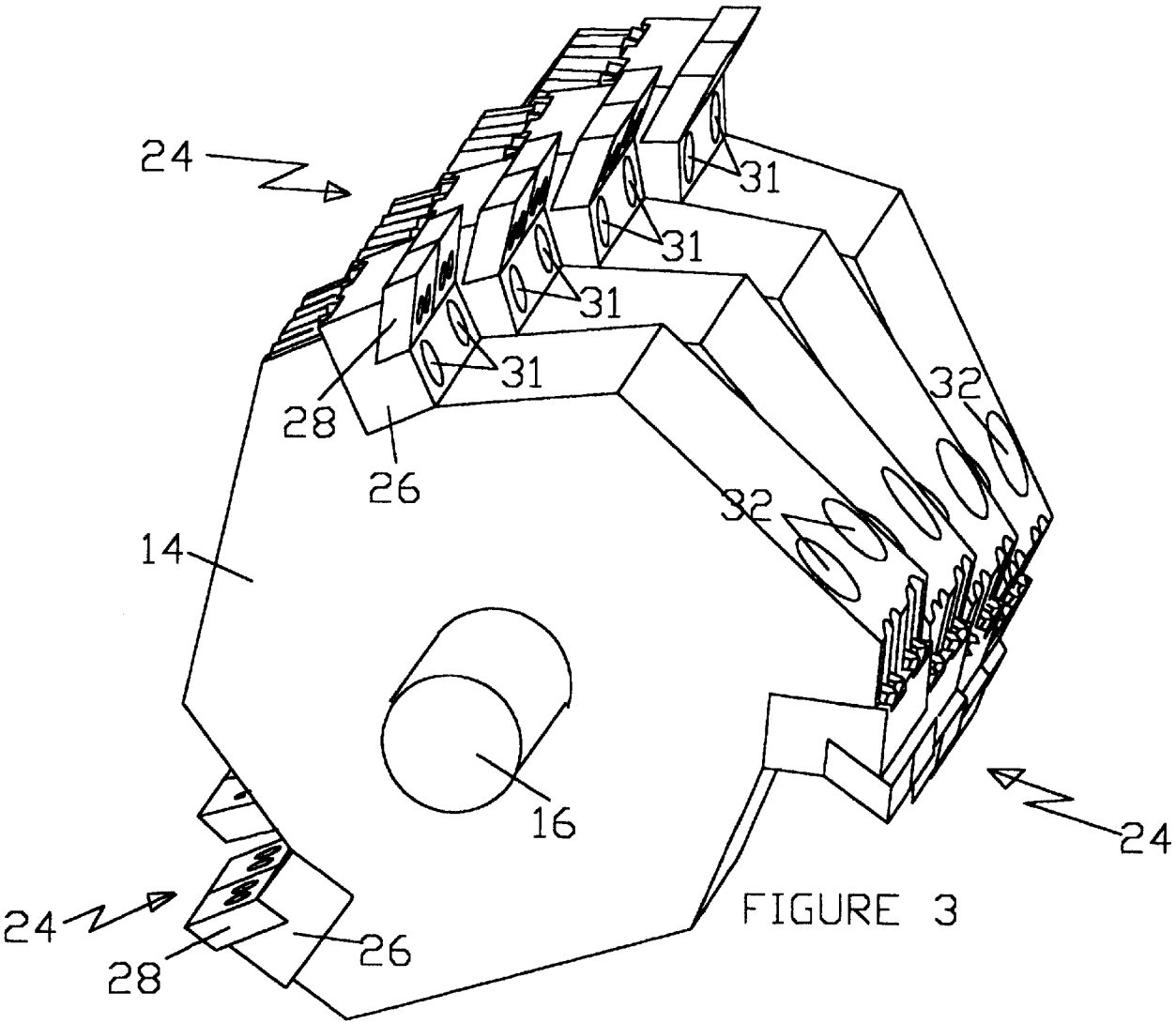
FIG. 3 is an alternative embodiment of an impact rotor for a stationary comminuter showing the impact member in a stepped arrangement.
Figure 4:
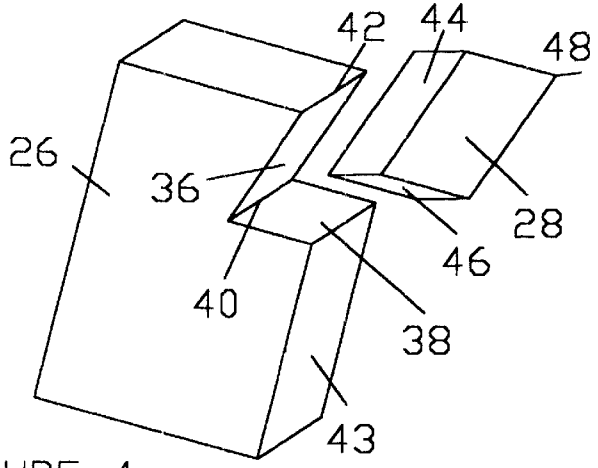
FIG. 4 is a schematic perspective view of the impact member showing certain details embodying the features of the present invention.

Referring to the drawings wherein the same reference numerals refer to similar parts throughout the several views, there is shown as an embodiment of my invention an impact member for use in a fixed or stationary comminuter, such as a wood hog, designated in general by the numeral 10 (see FIGS. 1–3). Suitable or conventional comminuters or apparatus of this general type are illustrated in U.S. Pat. Nos. 4,151,959; 5,165,611; and 5,273,218. The apparatus of this general type includes a feed input (not shown) which opens to a reduction chamber 12 having mounted therein an input rotor 14 typically made of hard steel and measuring from about 18 to 60 inches or longer in length. The size (including both length and diameter) and composition of the rotor will depend largely on the type of material to be processed, and the desired inertia of the rotor as determined by the size and speed or rotation (rpm). The rotor 14 is mounted on horizontal axle or shaft 16 extending transversely of the reduction chamber 12, and one end of the shaft is operatively connected to a motor (not shown) which provides rotational power to the shaft and in turn rotates the impact rotor, such as in a clockwise direction as indicated by the directional arrows in FIGS. 1 and 8. Anvil 18 and rear anvil or deflector 20 are positioned interiorly of the reduction chamber 12 to further act on the feed to effect size reduction by cutting, shearing, etc., and/or to deflect the feed back into the path of the impact rotor. A curved grate 21 is positioned below the rotor 14 and along the lower periphery of the reduction chamber 12, and is connected to the chamber housing as by bolts 22, for passing comminuted material of desired size.

Referring now in particular to FIGS. 2–6, there is shown in detail the impact member of the invention. The impact member, indicated generally by the numeral 24, comprises a carrier 26 and at least one impact plate 28, and is adaptable for extending substantially radially on the rotor 14 or about the periphery of the rotor. (See FIGS. 2 and 3.) The carrier and impact plate each are made as a single piece from a hard steel, and the impact plate is sufficiently hard and strong to exhibit good wear resistance, which is determined by the feed material and the inertia of the rotor. It is understood by those skilled in the art that the rotor can be any desired shape such as essentially triangular as shown, or quadrangular or other shapes, and the positioning of the impact member on the rotor is governed accordingly so as to provide essentially a symmetrical arrangement. Thus, the periphery of the rotor 14 is provided with a plurality of seats 30, preferably formed by an axially disposed shoulder and radially disposed neck substantially normal to the shoulder, as shown in FIG. 2, and the seats are spaced symmetrically about the periphery of the rotor. As illustrated in FIG. 2, the rotor is provided with spaced, peripheral seats to receive three impact members, that is, an impact member for each seat; or as shown in the modified embodiment in FIG. 3, the rotor can be provided with a plurality of seats, each oriented in a stepped or angled arrangement. In order to attach the carrier to the rotor, both members are provided with aligned holes 31 and 32 for accommodating a suitable fastening element 33, such as a bolt threaded at the end for a tightening nut, as shown in the drawings.

Figure 6:
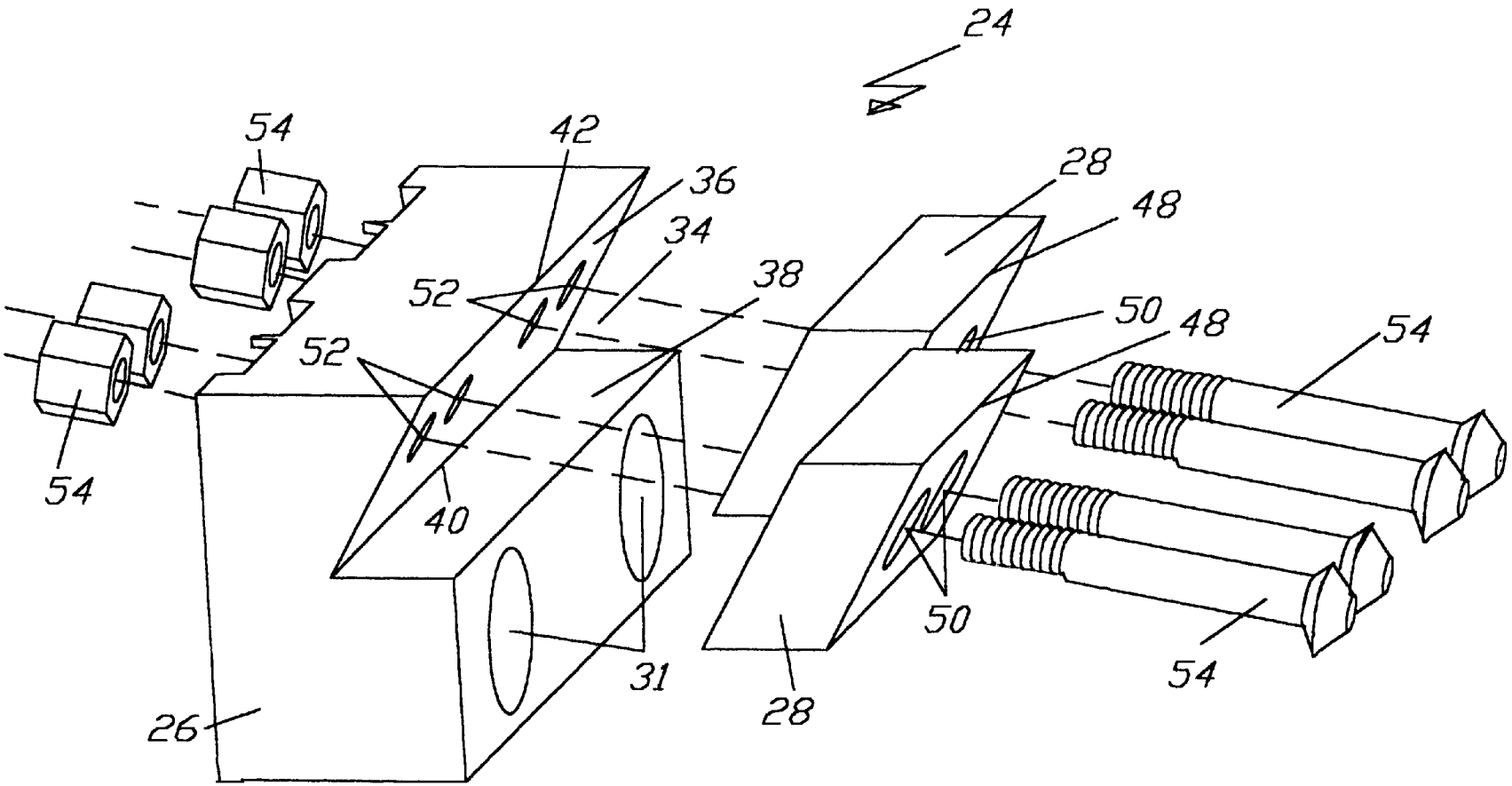
FIG. 6 is an exploded perspective view of the impact member of FIG. 5.

The carrier 26 of the impact member is essentially a rectangular block provided with a forwardly disposed, longitudinal open channel or recess 34, as best shown in FIG. 6. The recess or channel 34, which preferably extends the complete longitudinal length of the carrier, is formed by first facing 36 and second facing 38 intersecting along line 40 in an axial direction relative to the horizontal axis of the rotor 14, thereby defining an acute angle relative to the radial plane of the rotor. Thus, first facing 36 is sloped in the general direction of rotation of the rotor, and terminates with a longitudinal marginal edge 42 disposed axially relative to the rotor. The second facing 38 is essentially transverse to the general direction of rotation of the rotor. This acute angle defined by the facings is important in providing a locking system or assemblage of the impact plate with the carrier, as explained below in greater detail. This angle, though always an acute angle, may vary depending largely upon such factors as the inertia of the rotor as determined by its size and speed of revolution, the size of the impact member, and the feed material being processed, but desirably is about 60°±about 10°. The first and second facings 36 and 38, respectively, preferably are substantially planar or flat, but can be serrated at least over a portion of one or both facings, as described below.

Figure 5:
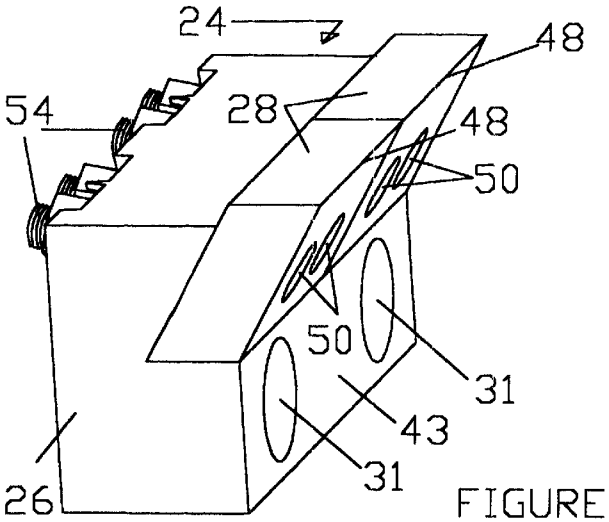
FIG. 5 is a perspective view of the impact member of FIG. 4.
Figure 8:
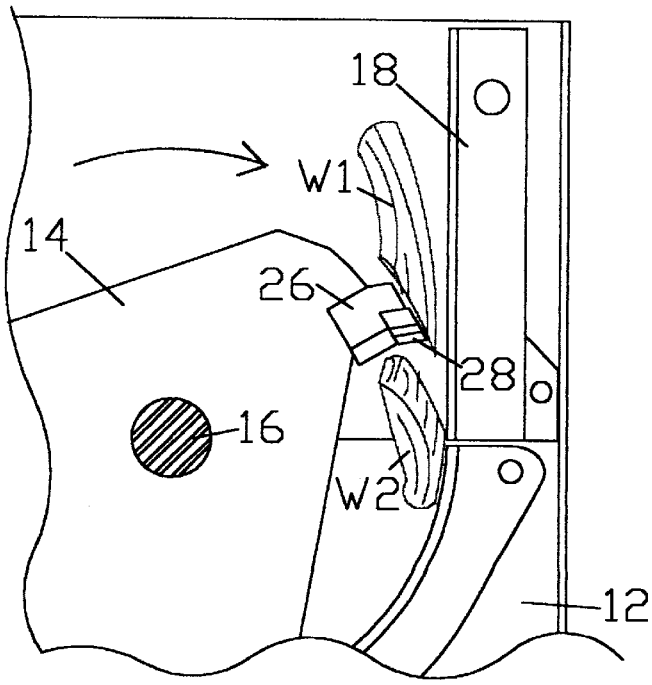
FIG. 8 is a diagrammatic, fragmentary view of the comminuter of FIG. 1 showing a piece of wood being cut to a reduced size.

The impact plate 28, sometimes referred to in the art as a bit, is a unitary body and essentially a rectangular block having opposed parallel surfaces and configured as a non-right angled parallelogram as viewed in transverse profile to the radial plane of the rotor. Thus, the intersecting sides 44 and 46 of the impact plate (see FIG. 4) are configured for complementary engagement with the first and second facings 36 and 38, respectively, of the recess 34, that is, side surface 44 rests against or engages facing 36 and side surface 46 rests against or engages facing 38. Because the impact plate is a parallelogram, the sides opposite to sides 44 and 46 are also configured for complementary engagement with the facings of the recess, which therefore makes it possible to reverse the impact plate when worn on one edge, as explained below. Thus, upon assembly of the impact plate with the carrier, the two sides 44 and 46 abut or engage facings 36 and 38, respectively, and lie flush in matching engagement therewith. Further, the parallelogram is dimensioned so that the length of side 44 is greater than the radial length of facing 36, and upon assembly of the impact plate with the carrier 26, a portion of the impact plate protrudes beyond or outward from the longitudinal marginal edge 42. It will be observed, therefore, that the leading edge or cutting edge 48 of the impact plate is disposed outwardly from the carrier and desirably forwardly of the surface 43, and is oriented in the general direction of rotation of the rotor. The distance the leading edge 48 protrudes outwardly from the marginal edge 42 can vary depending largely on the type of feed material and the inertia of the rotor, and as a general rule, this distance should be at least about one-eight inch, and with a lower inertia the distance can be greater. The leading edge then strikes the material fed to the reduction chamber 12, such as shown in FIG. 8 where a piece of wood has been cut into two pieces $W_1$ and $W_2$. As shown in the modified embodiment of FIG. 3, the carrier and impact plates are arranged in increasing radial angles in the axial direction of the rotor so as to create cutting edges having stepped surfaces. As explained above, the longitudinal length of the rotor can vary, and if the carrier is long, it may be desirable to provide two or more impact plates arranged axially and in abutting relation in the recess of the carrier, as shown in FIGS. 5 and 6.

Because the facings 36 and 38 define an acute angle and the sides 44 and 46 are in matching engagement with the facings, and because the leading edge 48 is oriented in the general direction or rotation of the rotor, the assemblage of the impact plate with the carrier provides a cantilever lock. That is, that portion of the impact plate that extends above the marginal edge of the carrier recess is unsupported by the carrier, and an impact at the leading edge will create an action of revolution about the fulcrum established by contact between the impact plate and the facings of the carrier. Thus, the impact plate is substantially locked or retained in place in the recess of the carrier, notwithstanding the rotation of the rotor and the cutting action of the impact plate. The unique configuration of the recess and impact plate and the complementary engagement of the surfaces provides a mounting retention or cantilever lock for the impact plate, thereby inhibiting any extended revolution from occurring. In order to insure the connection or assembly of the impact plate with the carrier, both are provided with holes 50 and 52, respectively, that align upon assembly for accommodating a suitable fastening element 54, such as a bolt, fastening pin, rivet, or the like. That is, the fastening element 54 helps in preventing the impact plate from undesirable disengagement, that is from slipping or jarring loose, but it should be understood that the primary locking system of the impact plate with the carrier is achieved by reason of the unique configuration of the recess and impact plate exhibiting matching registration.

Still further, the major area of impact and wear for the impact plate occurs at or along the leading edge 48. Therefore, when the leading edge is sufficiently worn so that its effective action is diminished, the impact plate, because it is a symmetrical parallelogram, can be turned to expose the diametrically opposite edge of the parallelogram to serve as the leading or cutting edge. In this manner, double use of the same impact plate is achieved before the plate needs to be machined and sharpened or be replaced with a new impact plate.

As an additional advantage of the invention, the cantilever lock explained above reduces and limits the load on the fastening elements 54, e.g. bolts, used for securing the impact plate in place on the carrier. Also, the impact plate assumes most or nearly all of the wear and fatigue. Thus, these relatively small bolts characterized by a low torque, e.g., a ½ inch bolt with a torque of about 300 foot pound per inch, and the relatively inexpensive impact plates are readily replaceable. This ease of replacement and low costs in both material and labor is in sharp contrast to the conventional comminuter utilizing a large hammer connected to the rotor with heavy bolts, as explained in the background section of this application. For example, replacing 30 impact plates of the present invention will take approximately 30 minutes, whereas to change nine hammers in a conventional apparatus takes about nine man hours.

Figure 7A:
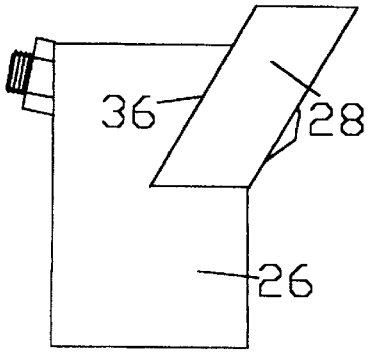
Figure 7B:
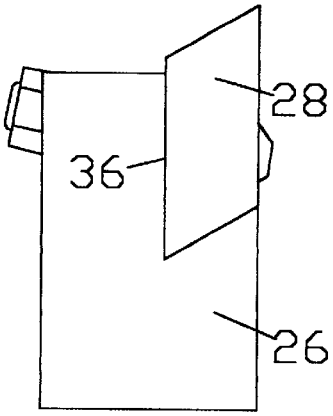
Figure 7C:
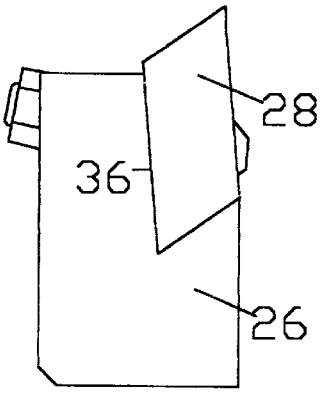

There is shown in FIGS. 7A, 7B, and 7C three possible slopes for the first facing 36 of the recess 34 relative to the radial plane of the rotor: namely, a positive slope, a neutral slope, and a negative slope. In these figures, each facing is oriented in the general direction of the rotation of the rotor. FIG. 7A shows a positive slope of the facing as being forward of the radial plane of the rotor; FIG. 7B shows a facing with a neutral or parallel slope relative to the radial plane; and in FIG. 7C the slope is negative, that is inclined rearwardly relative to the radial plane. Regardless of the slope, the angle defined by the two facings 36 and 38 is always an acute angle, and therefore the position of the second facing relative to the first facing will vary depending on the slope of the first facing.

Figure 9B:
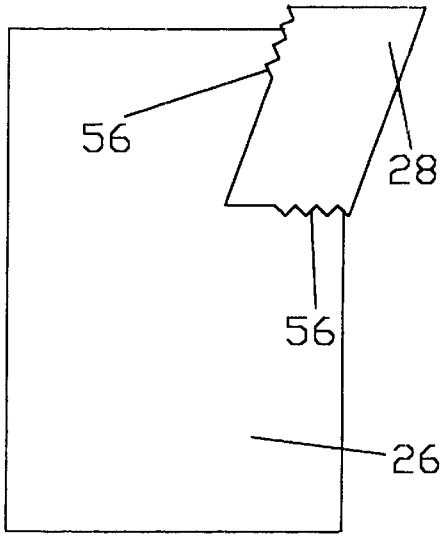
FIGS. 9A and 9B are schematic, side elevational views of alternative embodiments of the impact member of the present invention.
Figure 9A:
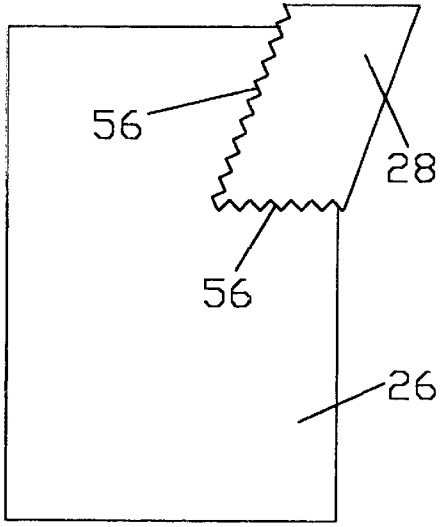

In a further modification of the present invention, the adjoining areas for the impact plate and carrier can be serrated at 56, as shown in FIGS. 9A and 9B. Thus, one or both facings 36 and 38 can be serrated for at least a portion of the facing, and matching surfaces 44 and 46 are serrated for complementary engagement with the facings. The serrations can provide a more secure lock of the impact plate with the carrier.

Figure 10:
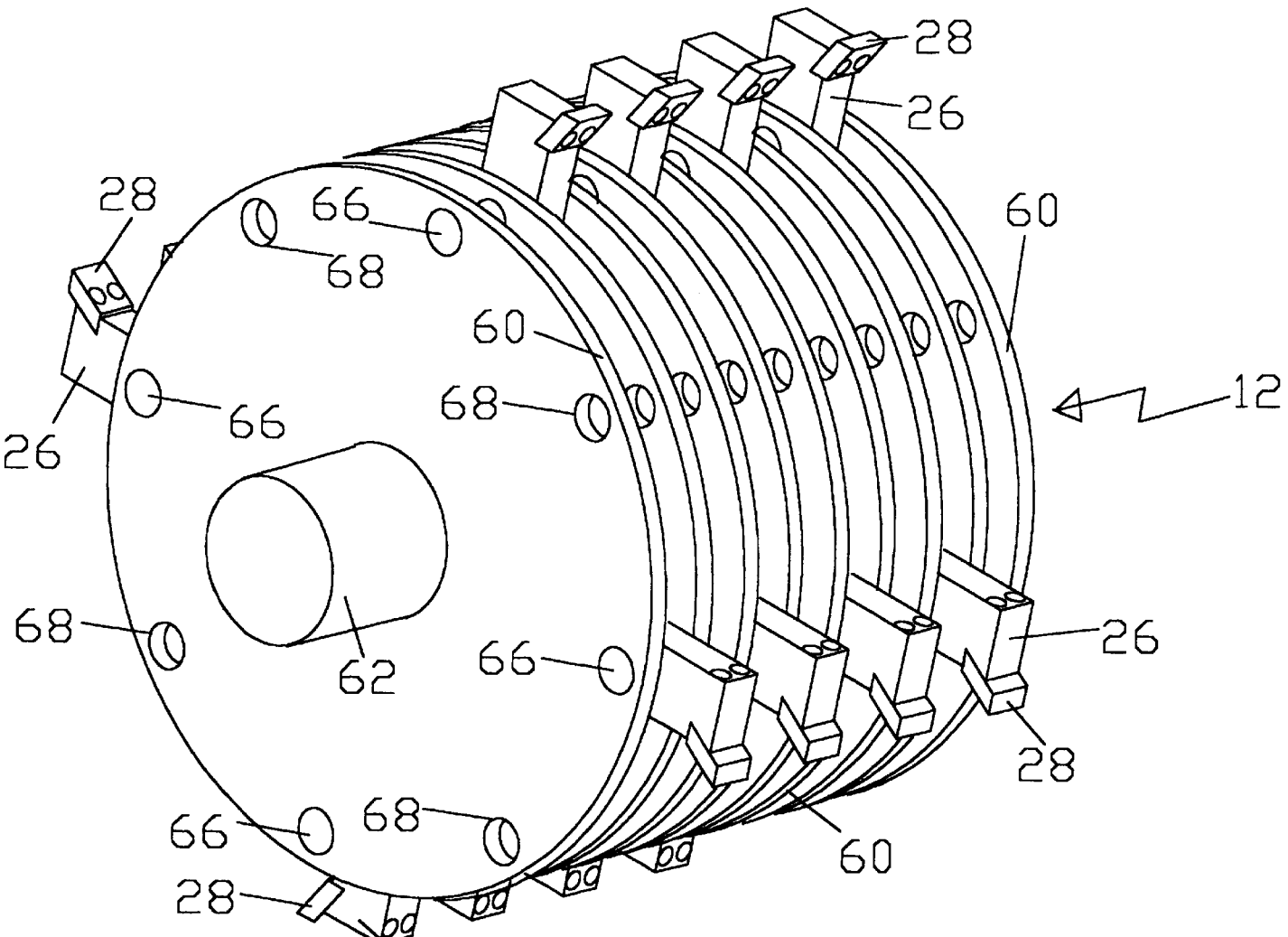
FIG. 10 is a perspective view of a swinging hammer comminuter utilizing the impact member of the present invention.
Figure 11:
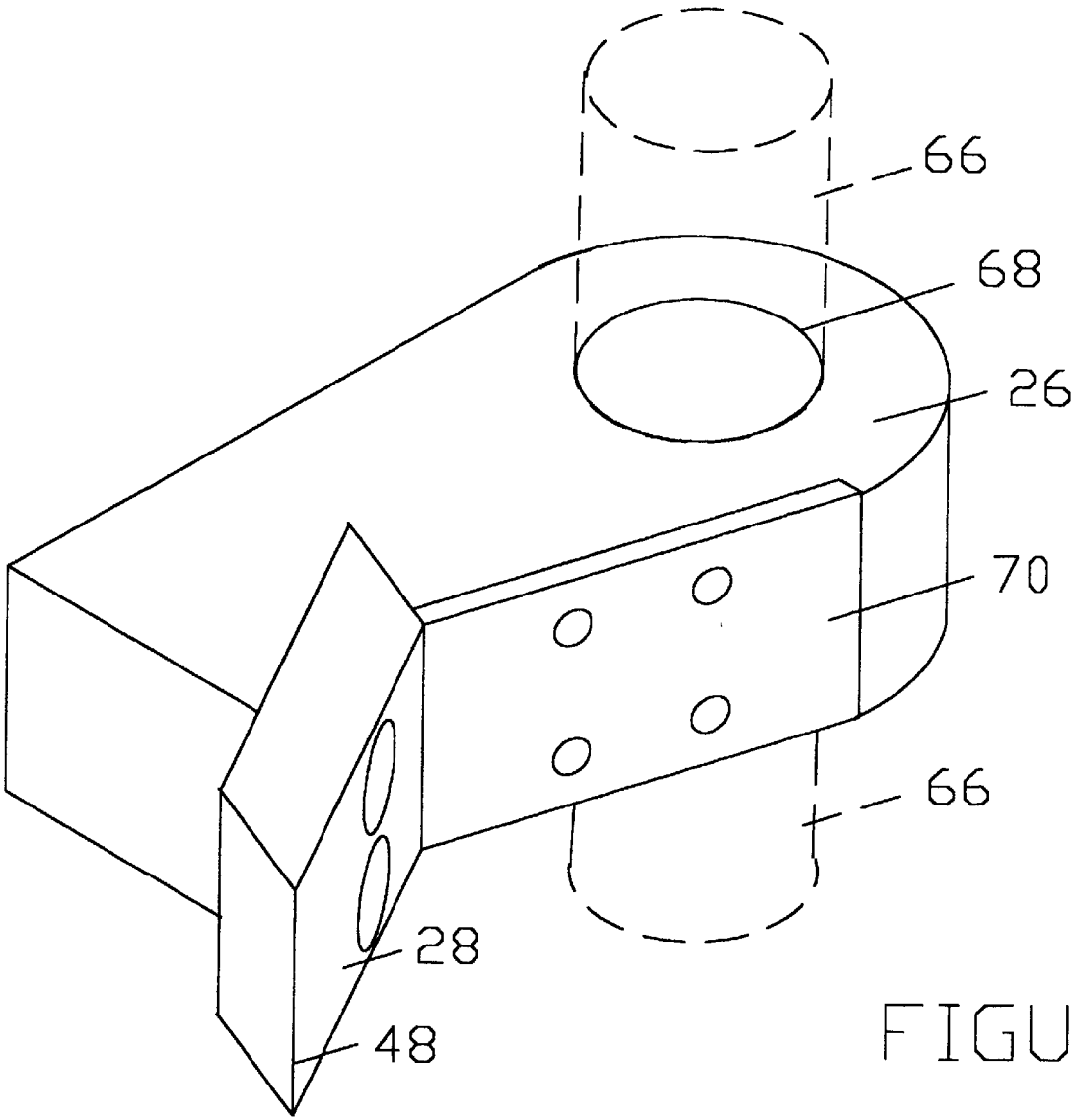
FIG. 11 is view of the hammer of the comminuter of FIG. 10 and showing in greater detail the impact member of the present invention.

The present invention can be useful also in a swinging hammer type comminuter, such as illustrated in FIGS. 10 and 11. According to this embodiment, the comminuter comprises a horizontally disposed rotor 12 made up of a plurality of spaced discs 60 rotated on a drive shaft or axle 62 driven by a suitable motor (not shown). A plurality of carriers 26 are symmetrically arranged on the rotor, a single carrier being positioned between two discs of the rotor. A stationary or fixed shaft or bar 66 extends axially through the discs near the periphery of the discs, and each carrier is provided with an opening or hole 68 for pivotally mounting the carrier on the shaft. Each carrier 26 is provided with a recess having intersecting facings defining an acute angle, and two surfaces of the impact plate 28, having a parallelogram profile, are arranged in matching registration with the recess facings such that the impact plate protrudes outwardly of the carrier, thereby providing a cantilever lock, substantially as described above. Thus, as the rotor revolves, the carriers 26 swing on the fixed shaft, and the leading edge 48 of each impact plate impinges on the feed material. Where desired, a replaceable wear plate 70 my be secured to the carrier, as with bolts or other suitable fastening means, to protect the forward surface of the carrier that might be exposed to the impact of feed material.

It will be observed that by reason of my invention numerous advantages are achieved in providing a replaceable impact plate that is cantilevered from a carrier mounted to a rotor and securely locked by reason of the configuration of the seat for the impact plate and the matching engagement of the two members. Further, it should be understood that the foregoing detailed description has been given for clearness of understanding only, and no unnecessary limitations should be understood therefrom, as modifications will be obvious to those skilled in the art.

What is claimed is:

1. An impact member for assembly with a rotor for use in a comminuter, comprising:

(a) a carrier adaptable for extending substantially radially about the rotor and having a forwardly disposed open recess with first and second facings intersecting in an axial direction relative to the horizontal axis of the rotor to define an acute angle relative to the radial plane of the rotor, said first facing being oriented in the general direction of rotation of the rotor and terminating with a longitudinally extending marginal edge disposed axially relative to the rotor;

(b) a replaceable impact plate configured as a substantially non-right angled parallelogram as viewed in transverse profile having intersecting sides for complementary registration with said first and second facings of said recess and cantilevered from said recess so as to project outwardly from said marginal edge and having a leading edge oriented in the general direction of rotation of the rotor, whereby said complementary registration substantially locks said impact plate in said recess of said carrier; and (c) means for preventing undesired disengagement of said impact plate from said carrier.

2. An impact member for assembly with a rotor according to claim 1 wherein said recess extends the axial length of said carrier, and at least two wear resistant members are mounted axially in said recess and in abutting relationship.

3. An impact resistant member for assembly with a rotor according to claim 1 wherein said impact plate has a serrated cutting edge oriented in the direction of rotation of the rotor.

4. An impact member for assembly with a rotor according to claim 1 further including aligned holes in said carrier and said impact plate, and said fastening means comprises bolts extending through said aligned holes.

5. An impact member for assembly with a rotor according to claim 1 wherein said first facing is inclined forwardly relative to the radial plane of the rotor.

6. An impact member for assembly with a rotor according to claim 1 wherein said first facing is substantially parallel to the radial plane of the rotor.

7. An impact member for assembly with a rotor according to claim 1 wherein said first facing is inclined rearwardly relative to the radial plane of the rotor.

8. An impact member for assembly with a rotor according to any one of claims 1–7 wherein said first and second facing are substantially planar.

9. An impact member for assembly with a rotor according to any one of claims 1–7 wherein at least a portion of said first and second facings are serrated and at least a portion of said intersecting sides of said parallelogram have matching serrations.

* * * * *